US005346130A

United States Patent [19]

Rademaker

[11] Patent Number: 5,346,130

[45] Date of Patent: Sep. 13, 1994

[54] THERMALLY RESPONSIVE AIR DIFFUSER

[75] Inventor: Johan Rademaker, West Olive, Mich.

[73] Assignee: Hart & Cooley, Inc., Holland, Mich.

[21] Appl. No.: 927,811

[22] Filed: Aug. 10, 1992

[51] Int. Cl.[5] ..... F24F 13/08

[52] U.S. Cl. ..... 236/49.5; 454/258; 454/297

[58] Field of Search ..... 236/49.5; 138/45; 454/258, 297, 299, 304; 251/212

[56] References Cited

U.S. PATENT DOCUMENTS

| | | | |
|---|---|---|---|
| Re. 25,216 | 8/1962 | Kennedy | 98/40 |
| Re. 30,953 | 6/1982 | Vance et al. | 236/49 |
| 373,324 | 11/1887 | Wheeler | 236/49 |
| 2,396,025 | 3/1945 | Seid | 454/258 |
| 2,487,367 | 11/1949 | Peple, Jr. | 236/49.5 |
| 2,837,991 | 6/1958 | DeRoo | 98/40 |
| 3,743,180 | 7/1973 | Perkins et al. | 236/49.5 X |
| 3,765,316 | 10/1973 | Skoch | 251/318 |
| 4,123,001 | 10/1978 | Kolt | 236/49.5 |
| 4,258,616 | 3/1981 | Zeller et al. | 239/562 |
| 4,497,241 | 2/1985 | Ohkata | 236/49 |
| 4,501,389 | 2/1985 | Kolt | 236/49.5 |
| 4,515,069 | 5/1985 | Kline et al. | 236/48 R |
| 4,535,932 | 8/1985 | Herb | 236/49 |
| 4,570,850 | 2/1986 | McDermott | 236/49 |
| 4,625,629 | 12/1986 | Bryans | 98/40.17 |
| 4,697,736 | 10/1987 | Kolt | 236/49.5 |
| 4,815,934 | 3/1989 | Rademaker | 415/191 |

*Primary Examiner*—William E. Tapolcai

*Attorney, Agent, or Firm*—Varnum, Riddering, Schmidt & Howlett

[57] ABSTRACT

A thermally powered change over diffuser for controlling the flow orientation of air discharged from a ceiling mounted duct outlet includes a pair of vanes pivotably mounted on a platform for scissor-wise movement between an open and a closed position, and a thermally responsive actuator. Discharge of cooled air from the duct causes the actuator to move the vanes together into the closed position, blocking the center of the flow path, and forcing the discharge air to exit in a substantially horizontal orientation. Discharge of heated air causes the actuator to move the vanes apart, into the open position, allowing warm air to flow vertically downwardly into a building space.

16 Claims, 6 Drawing Sheets

THERMALLY RESPONSIVE AIR DIFFUSER

BACKGROUND OF THE INVENTION

1. Field of the Invention

This invention relates to air diffusers and, more particularly, to air diffusers having arrangements for selectively controlling air flow based on thermal characteristics.

2. Description of Related Art

The use of air distribution units or diffusers as part of a heating, ventilating and air conditioning (HVAC) system is relatively well known. Such systems often include an air distribution system comprising a network of air ducts which supply heated or cooled air to various spacial areas in a building ventilated by the HVAC system. The air is discharged from the ducts into the ventilated areas by a series of air outlets. Typically, a diffuser is provided at or near the air outlet to control the flow of air entering the ventilated areas, and to provide an even distribution of air to a desired area without undue noise or uncomfortable drafts to disturb the occupants. The diffuser generally employs one or more vanes or deflectors to direct the discharge air flow in the desired orientation.

It is well known that the most effective manner of distributing air from diffusers during cooling is to direct the air in a horizontal flow across the ceiling of the room by employing what is known in the industry as the "Coanda effect." A stream of air discharged from a diffuser at an angle less than approximately 35 to 40 degrees with respect to the ceiling will tend to create a partial vacuum and cause the air stream to remain in contact with or hug the ceiling as a result of the Coanda effect. Cool air, therefore, can be distributed over a substantial area of the ceiling by employing the Coanda effect before the cool air begins to "sink down" into the room to cool the entire volume of the room.

In contrast, the best efficiency in connection with the distribution of hot air from ceiling mounted diffusers is for the air to be discharged in a generally vertically oriented stream. The vertical flow component overcomes the natural buoyancy of the heated discharge air to serve the lower strata of the room with heated air and to thereby achieve a proper mixing of the heated air with the room air. Because the discharged air flows through the occupied space before mixing is complete, drafts may be directed at the occupants. However, most people do not perceive warm drafts as uncomfortable.

In many HVAC applications, the same duct outlet may selectively discharge either heated or cooled air during different times of the day. For instance, thermostats are typically set back to 65° F. or lower during the middle of the night. In the morning, most of the duct outlets will be discharging heated air to bring the air in the building up to its desired daytime temperature setting. As the day progresses, interior heat loads from people, lighting and computers may require that cooled air be directed to the interior of the building. Also, a southern exposure of the building will likely experience a solar warming load which must be overcome with cooled air directed to that part of the building. Particularly in the Spring and Fall, all areas of the building may require heated air in the morning and cooled air during the middle of the day.

While it is desireable to change the orientation of the air exiting the duct outlet, it is inconvenient to manually adjust a diffuser several times during the course of the day. Further, some buildings, such as banks and shopping malls, have their duct outlets located in high ceilings. Even infrequent adjustments of a manual diffuser is inconvenient in such locations. To address these problems, diffuser or air distribution units have been previously developed which automatically adjust the air distribution from a diffuser. Typically these systems employ some form of control system to sense the temperature of the discharge air and to control motorized adjustable vanes in the diffusers to adjust the air flow.

Several diffusers or air distribution units have been developed which incorporate the concept of a non-motorized, thermally responsive element to adjust the air distribution. For instance, in Kline et al., U.S. Pat. No. 4,515,069 issued May 7, 1985, a thermally responsive actuator rotates a blade assembly so that when warm air is flowing through the duct, a hot blade directs air primarily downward. When cold air is flowing through the duct, a separate cold blade directs the air primarily across the ceiling. The blades in Kline et al. comprise generally vertically oriented, opposite sides of a diamond-shaped box. By changing the orientation of the box in a duct, either the hot or cold blade may be presented to the air flow. A path formed between the selected blade and an opposing wall of the duct directs the air flow in the desired direction. The cold blade is angled more sharply off the vertical axis and interacts with a ramp wall formed in the duct to direct the air flow across the ceiling, while the hot blade is angled less sharply off the vertical axis to direct the air flow generally vertically downward.

The angle of the box in Kline et al. is controlled by a thermally responsive actuator or "pill" located in the flow path to sense the temperature of the air flow discharging the diffuser. The pill has a cavity filled with wax which expands upon melting at a predetermined temperature, thereby causing a piston to move outwardly from the cavity. At cooler temperatures, the wax solidifies and contracts. The piston is connected to the box by a linkage, so that movement of the piston into and out of the pill provides the motive force to operate the diffuser without the aid of additional motors and the like.

Two somewhat related patents, Herb, U.S. Pat. No. 4,535,932 issued Aug. 20, 1985, and Bryans, U.S. Pat. No. 4,625,629 issued Dec. 2, 1986, each employ a pill to operate a diffuser which selects between two discharge outlets depending upon the temperature of the discharge air. One discharge outlet directs the flow against a wall, and the other discharge outlet directs the flow into the interior of a room. The pill directs a baffle to selectively block one of the discharge outlets.

A separate concept for controlling the vertical and horizontal flow components of the discharge air is disclosed by Kennedy, U.S. Reissue Pat. No. 25,216 reissued Aug. 7, 1962. Kennedy controls the vertical and horizontal flow components of the discharge stream by selectively obstructing the central flow path of the air exiting the diffuser. With the central flow path blocked, the discharge flow is substantially horizontal. With the central flow path unobstructed, the discharge flow is substantially vertical.

The Kennedy diffuser comprises a perforated deflector of smaller area than, and in a substantially parallel orientation to, a perforated duct outlet face plate. The position of the deflector is controlled by a bellows which expands and contracts in response to the temperature of the air passing through the duct. In the warm air position, the perforations in the deflector and face plate are in register and allow air to pass through the center of the face plate. In the cold air position, the perforations and the deflector and face plate are out of register, preventing air from passing through the center of the face plate and forcing the air to exit the face plate with a more horizontal orientation. By blocking the air passageways, the deflector of Kennedy restricts the volume of air passing through the face plate when it is in the cold position.

Due to the large number of diffuser outlets in any given building, it is desirable that each be relatively simple and inexpensive. If adjustable diffuser outlets are used, it is desireable that each be quick and easy to adjust to accommodate variable air discharge temperatures. Automatically adjustable diffusers effectively address the latter requirement. However, many of the prior art automatic temperature controlled diffusers are unnecessarily complicated, employing sophisticated control systems and motorized diffuser elements to automatically select the appropriate flow pattern for a given temperature of discharge air.

An additional limitation of many prior art devices is the reduction of the area of the duct outlet when adjusted to discharge cooled air, thus reducing the volume of air discharging the diffuser. This has several disadvantages. For example, cooled air discharge temperatures are typically much closer to the desired building temperature than heated air discharge temperatures. Obtaining a given amount of cooling in a building space therefore requires proportionally more discharge air volume than an energy equivalent amount of heating in the same space. Reducing the area of the diffuser when discharging cooled air reduces the volume of discharge air precisely when an increased volume is desired.

Another instance where it is undesirable to reduce the volume of discharge air through individual diffusers is when using a variable air volume (VAV) control system. VAV systems employ dampers in the ductwork to direct a varying volume of air to a particular building space so as to achieve a desired air temperature in that space. An air diffuser which further restricts the volume of air entering the space makes control of the VAV system more difficult. For example, the air flow across a restricted duct outlet may create excessive noise.

SUMMARY OF THE INVENTION

In accordance with the invention an air diffuser arrangement is mountable in an air duct for control of air flow patterns through the duct. The diffuser arrangement includes at least two vanes pivotably mountable to a supporting structure in the air duct, with each of the vanes being movable between a closed position and at least one open position to selectively restrict and unrestrict the central path of the air flow. The diffuser arrangement also includes an actuator means, mountable to the supporting structure and connected to the vanes, for controlling positioning of the vanes. The vanes control the air flow through the duct by selectively restricting, in response to the actuator means, the central path of the air flow, when positioned in the closed position.

The closed position can be defined by the vanes abutting each other to form a substantially contiguous flow path restriction. The open positions can be defined by at least one of the vanes being spaced apart from at least one other of the vanes. Each of the vanes can include a first end and a second end, be pivotably mountable to the supporting structure at the first end, so that the first ends of the vanes are in alignment and the vanes are moveable between the closed and the open positions in a scissor-wise fashion.

The air diffuser arrangement can include a biasing means mountable to the supporting structure for biasing the blades towards the closed position. The actuator means can include a thermally responsive element, which provides a force to overcome the biasing means and move the vanes to one of the open positions in response to temperatures exceeding a predetermined value. The thermally responsive element can include a container having a closed end and an opposite end, a piston operating inside the container, a pressure tight seal between the piston and the container, a thermally expansive material contained inside the container between the closed end and the piston, a piston rod extending from the piston out of the opposite end of the container and interconnected to the vanes. An expansive pressure is generated by increasing the temperature of the thermally responsive material and the pressure operating against the piston causes a force tending to move the piston and the piston rod outwardly of the container to cause a force to overcome the biasing element and move the vanes to one of the open positions in response to temperatures exceeding a predetermined value.

In accordance with one aspect of the invention, an air diffuser arrangement is mountable in an air duct for control of air flow patterns through the duct. The diffuser arrangement includes at least two vanes. Each of the vanes is pivotably mountable at a pivot point to a supporting structure in the air duct, and the vanes have at least one open position. A control mechanism is mountable to the supporting structure, for applying a force at a location on each of the vanes to cause a torque about the pivot points. The control mechanism includes a biasing means for applying a force in the location to cause a torque and a positioning means for applying a force in the location to cause an opposite torque to control the position of the vane.

The closed position can be defined by the vanes abutting each other to form a substantially contiguous flow path restriction. The open positions can be defined by at least one of the vanes being spaced apart from at least one other of the vanes. Each of the vanes can have a first end and a second end, be pivotably mountable to the supporting structure at the first end, so that first ends of each of the vanes are in alignment and the vanes are moveable between the closed and the open positions in a scissor-wise fashion.

The air diffuser arrangement can include a wall mountable to the supporting structure, with the biasing means including at least one spring connected between the vanes and the wall. The positioning means can include a thermally expandable unit wherein temperature above a predetermined level in the duct produces an expansive force. The wall can have an opening and the thermally expandable unit can have a brace. The thermally expandable unit is partially received in the opening and the brace prevents further movement, in at least one direction, of the thermally expandable unit through the opening. The control mechanism can include a bracket, connected between the vanes and the biasing and positioning means, for translating forces between the biasing and the positioning means to the vanes so as to cause a torque on the vanes about the pivot points.

BRIEF DESCRIPTION OF THE DRAWINGS

The invention will now be described with reference to the drawings wherein.

DESCRIPTION OF THE PREFERRED EMBODIMENT

Figure 1:
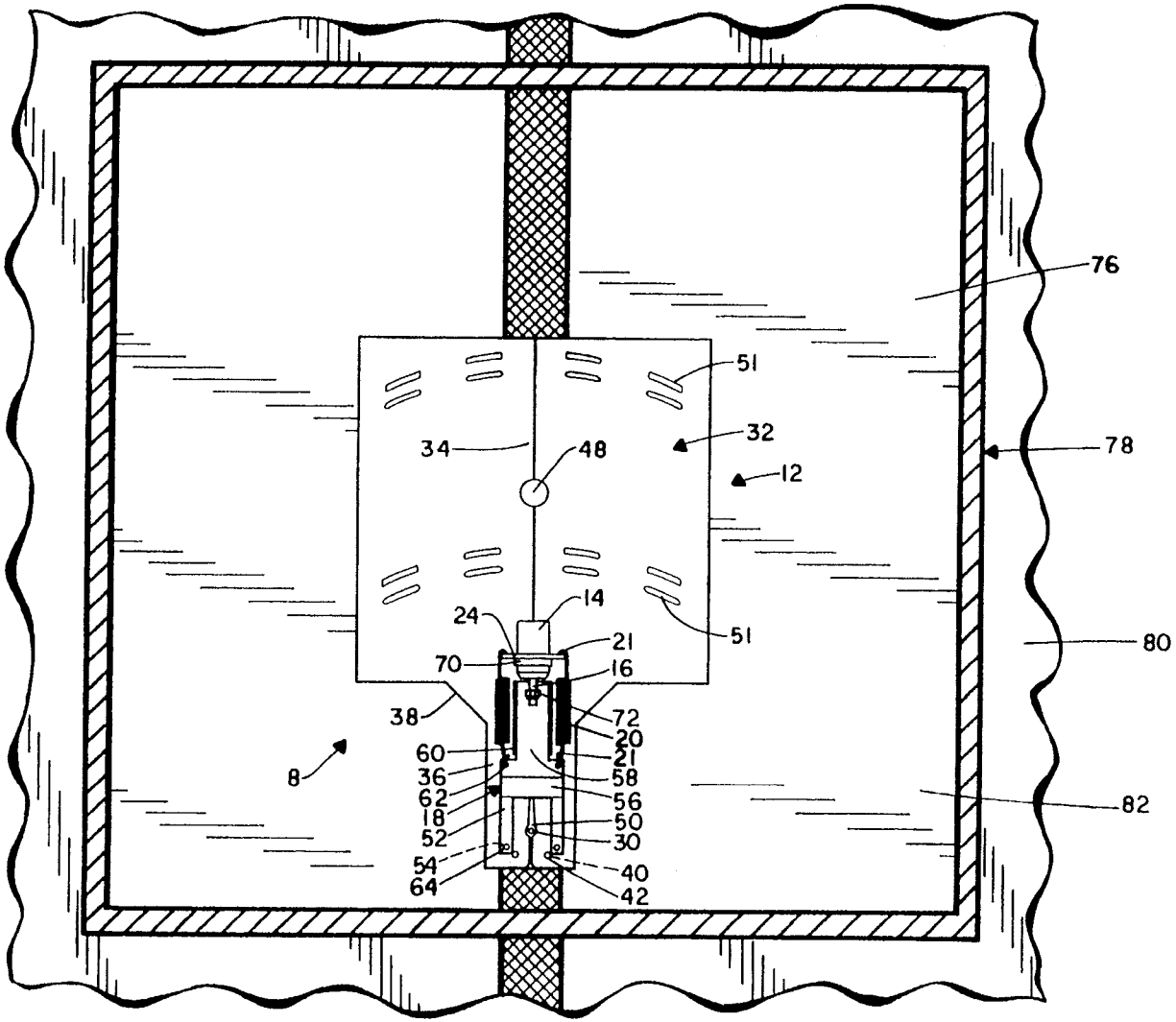
FIG. 1 is a plan view of a thermally responsive diffuser according to the invention, shown installed in a ceiling duct outlet.

Referring now to the drawings and to FIG. 1 in particular, a thermally responsive air diffuser 8 in accordance with the present invention is shown mounted in an air duct 78. The air diffuser 8 automatically adjusts the air flow pattern of air discharging from the duct 78, based on the discharge air's temperature. When cool air is discharged, the diffuser 8 directs the flow substantially horizontally. When warm air is discharged, the diffuser 8 directs the flow substantially vertically. The diffuser 8 is relatively simple in design, and facilitates ease of manufacture. The effective cross-sectional area of the discharge air flow path is substantially the same, regardless of whether the diffuser 8 is discharging warm or cool air.

Figures 2, 7:
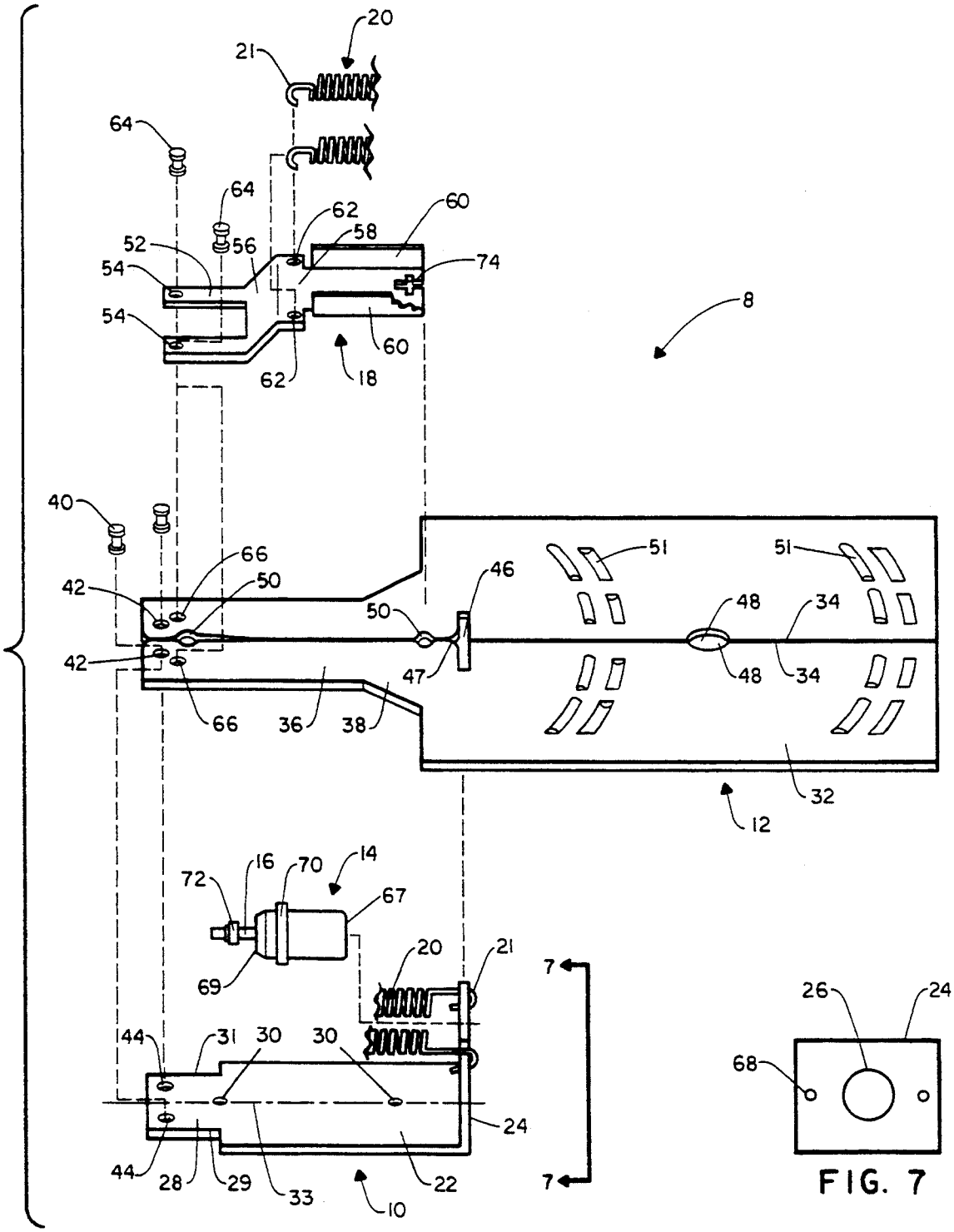
FIG. 2 is an exploded perspective view of the diffuser of FIG. 1.
FIG. 7 is a sectional view of a platform wall of the diffuser shown in FIG. 2, taken along line 7–7 of FIG. 2.

Referring now to FIG. 2, and briefly describing certain major components of the diffuser 8, the air diffuser 8 comprises a mounting platform 10, two symmetrical diffuser vanes 12, thermally responsive pill 14, piston 16, bracket 18, and a pair of biasing springs 20. The mounting platform 10 comprises a flat rectangular base portion 22 and a right-angled rectangular wall 24 perforated by a central circular opening 26 (FIG. 7). Preferably the wall 24 may be formed by bending a section of the base portion 22 to form the right angled wall 24. At the opposite end from the wall 24, the base portion 22 narrows to form a tab 28. The tab 28 is preferably rectangular, and formed by removing rectangular cutouts 29, 31 from each corner of the end of the base portion 22. Holes 30 may be provided for mounting the platform 10 into the air handling duct 78 (FIG. 1), and are preferably located along a midline 33 of the base portion drawn between the wall 24 and tab 28.

Each of the diffuser vanes 12 comprises a relatively large rectangular blade 32, for redirecting the air flow in the duct 78 (FIG. 1). An inner edge 34 of the blade is extended at one end to form a pivot arm 36. The pivot arm 36 may be substantially rectangular, and narrower than the blade 32. A fillet 38 can be provided at the transition between the blade 32 and the pivot arm 36, for strength.

The diffuser vanes 12 are mounted to the platform 10 by means of a rivet 40 through holes 42 in the pivot arms 36 and holes 44 in the tab 28 of the platform 10. The holes 42 in the diffuser vanes 12 are located along the inner edge 34 near the end of the pivot arm 36. The diffuser vanes 12 can thus pivot about an axis formed by the rivet 40. Deep longitudinal slots 46 are cut into each diffuser vane 12 to accommodate the wall 24 when the vanes 12 pivot into the closed position. As shown in FIG. 2, the inner edges 34 of opposite vanes 12 abut each other, yet do not overlap. The slots 46 are sized to engage the wall 24 and prevent the vanes 12 from rotating inwardly past the closed position. Preferably, an edge 47 of the slot 46 closest to the pivot 40 is chamfered to help prevent the wall 24 from binding in the slot 46 when the vanes 12 pivot closed.

A half circle cutout 48 may be provided in the central portion of the inner edge 34 of each blade 32, so that when the diffuser 8 is mounted in the ductwork, a tool (not shown) may be inserted through the cutouts 48 to access adjustable equipment in the duct such as dampers (not shown). Additional cutouts 50 may be provided in the inner edge 34 of the pivot arms 36, aligned with each of the mounting holes 30, to allow access thereto and to prevent the blades 32 from binding on mounting screws or rivets (not shown) used to mount the diffuser 8 in the ductwork by means of holes 30.

Figure 5:
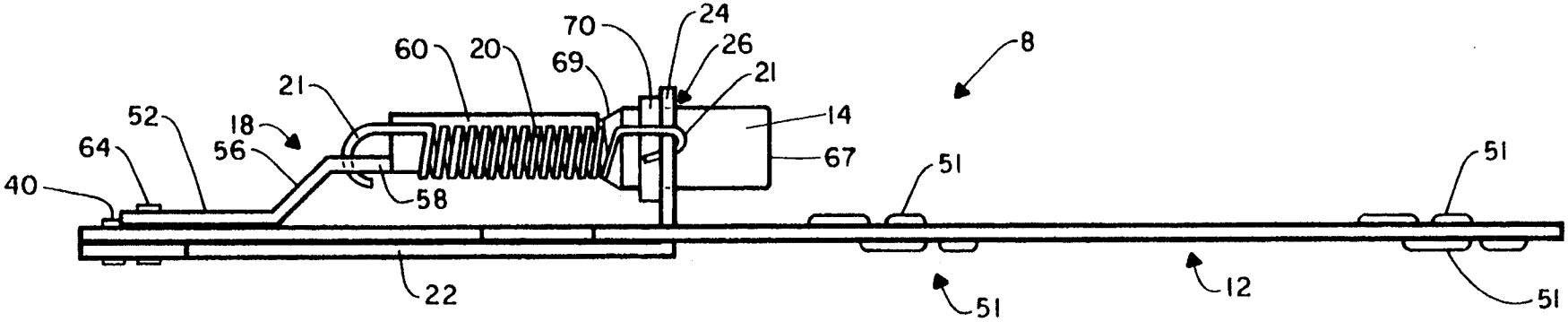
FIG. 5 is a side view of the diffuser of FIG. 1.

As most clearly shown in FIGS. 2 and 5, arced ridges 51 may be provided on the surface of the blades 32. Each arced ridge 51 must have a radius with its origin at the rivets 40. Guides (not shown) may be provided in the ductwork to engage the ridges 51 and prevent the blades 32 from binding on other components in the ductwork.

The bracket 18 has two rearwardly extending arms 52 having holes 54 at their rearward ends. The bracket 18 is rotatably attached to the pivot arms 36 on the vanes 12 by means of rivets 64 inserted through holes 54 in the bracket arms 52 and holes 66 at the rearward end of the pivot arms 36. A ramp portion 56 connects the two arms 52 and angles upwardly towards the upper bracket 58. Portions of the upper bracket 58 may be folded upwardly to form braces 60 along each side of the front portion of the upper bracket 58, thus strengthening the bracket 18 and narrowing the forward part of the upper bracket 58 to provide room for the springs 20 to operate.

Holes 62 are provided near each side of the rear of the upper bracket 58, outside of the braces 60, for mounting the springs 20. Holes 68 are provided in the upper corners of the wall 24 for mounting the springs 20. The springs 20 are coil springs, with the spring material bent at each end to form hooks 21. One hook 21 of each spring 20 mounts in a corresponding one of the holes 68 in the wall 24. The opposite hook 21, of the same spring 20, mounts in the corresponding hole 62 in the upper bracket 58.

The pill 14 is tubular in shape, having a first end 67 and a second end 69. A ring 70 encircles the circumference of the pill 14. The opening 26 in the wall 24 receives the first end 67 of the pill 14, from the side facing the tab 28. The opening 26 is sized to pass the pill 14, but will not pass the ring 70. The piston 16 protrudes axially from the second end 69 of the pill 14. The distal end of the piston 16 is expanded to form a flange 72. The piston 16 is mounted to the upper bracket 58 by means of one or more collars 74 on the upper bracket 58. The collars 74 can be formed by laterally cutting the material of the bracket 58, and deforming the material to form collars 74.

The springs 20 bias the bracket 18 forwardly, towards the wall 24. The bracket arms 52 pivotably mount to the pivot arms 36 at bracket rivets 64 further from the centerline 33 than the pivot arms 36 mount to the platform 10 at platform rivets 40. The forward tension of the springs 20, acting on bracket 18, imposes a forward force on the pivot arms 36, applied at the bracket rivets 64, thereby causing a torque about the platform rivets 40. This torque tends to urge the vanes 12 into the closed position. Thus, the vanes 12 are biased into the closed position by the springs 20.

Figure 3:
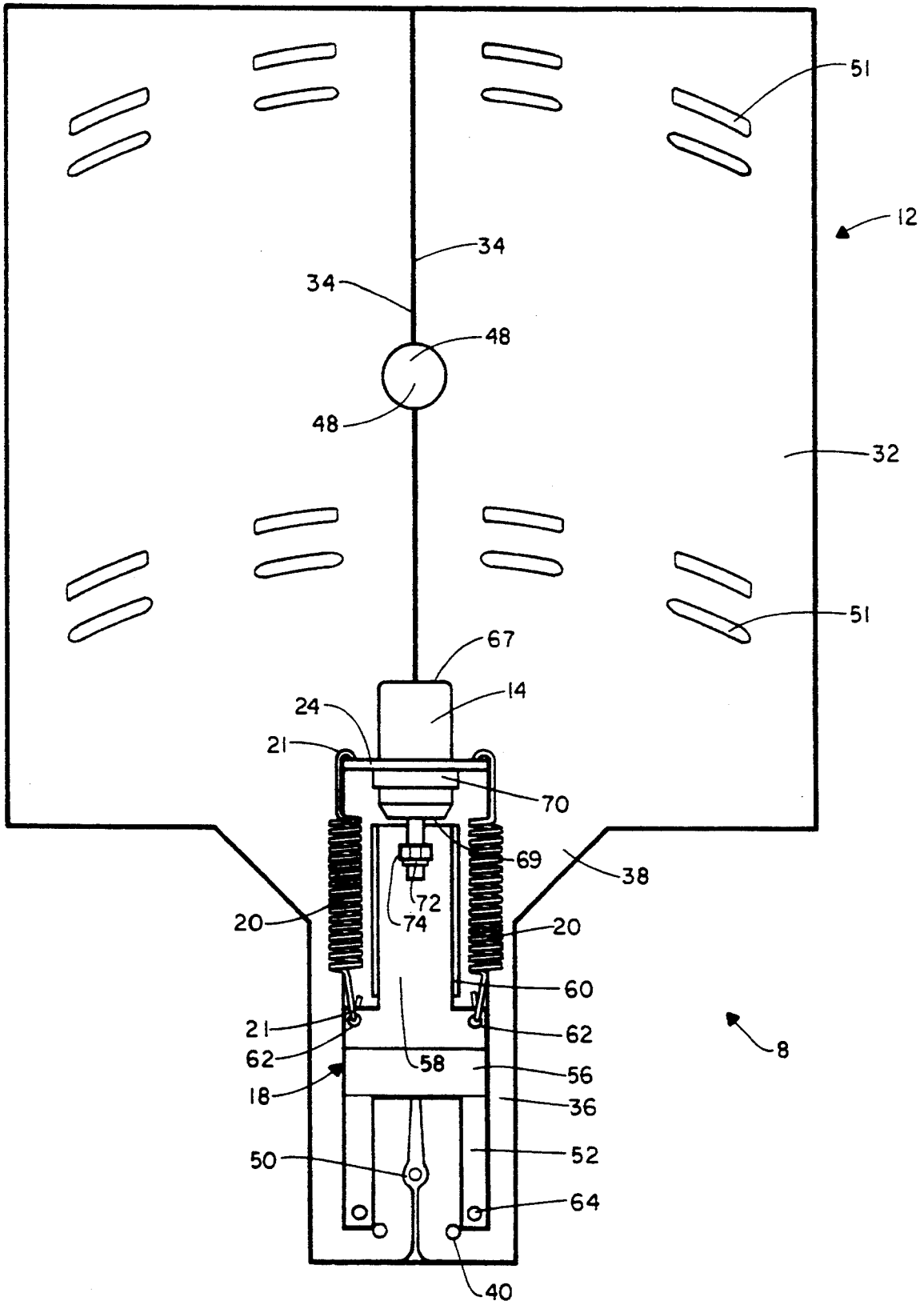
FIG. 3 is a plan view of the diffuser of FIG. 1, shown in the closed position.
Figure 4:
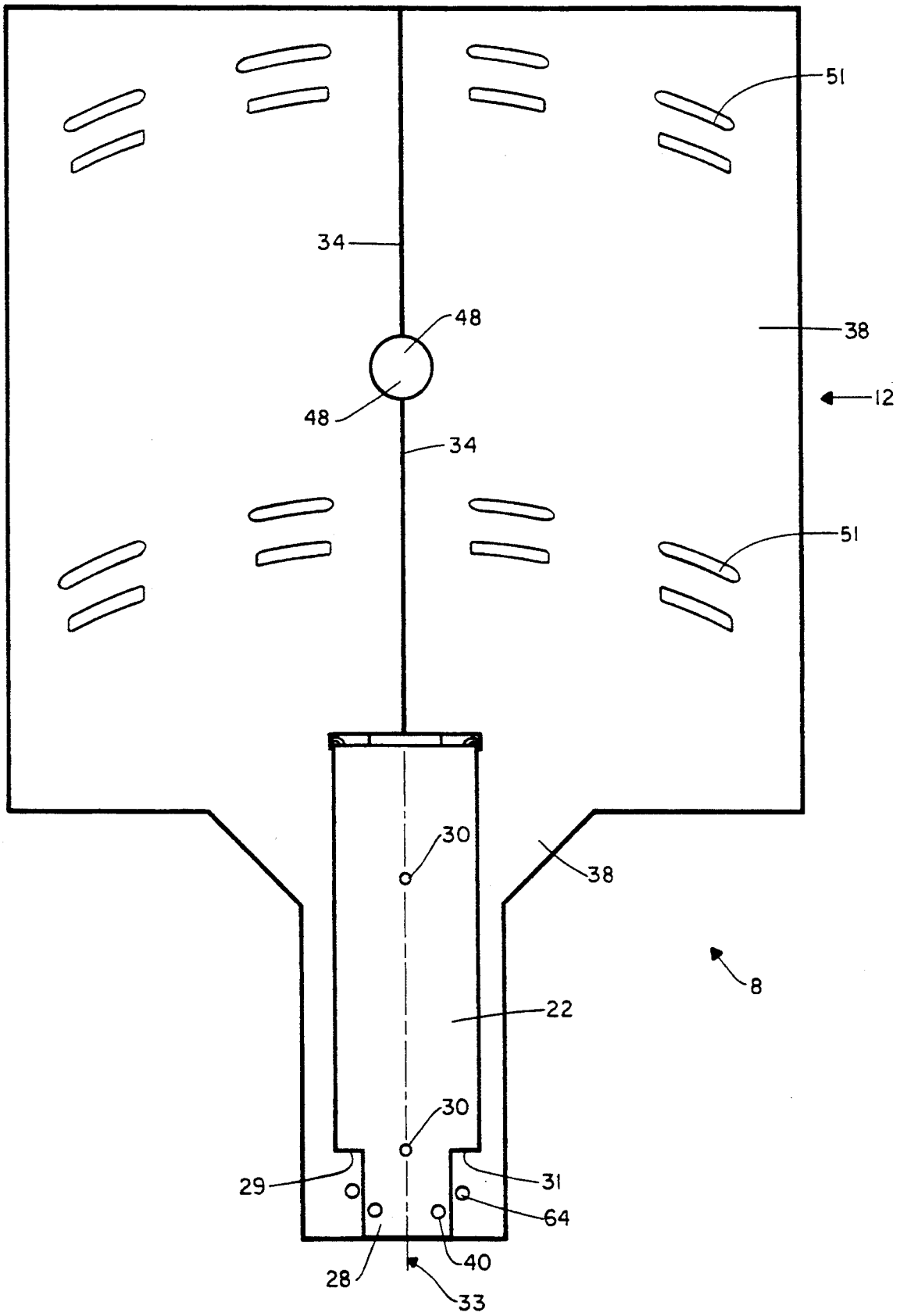
FIG. 4 is an underside view of the diffuser of FIG. 1.
Figure 6:
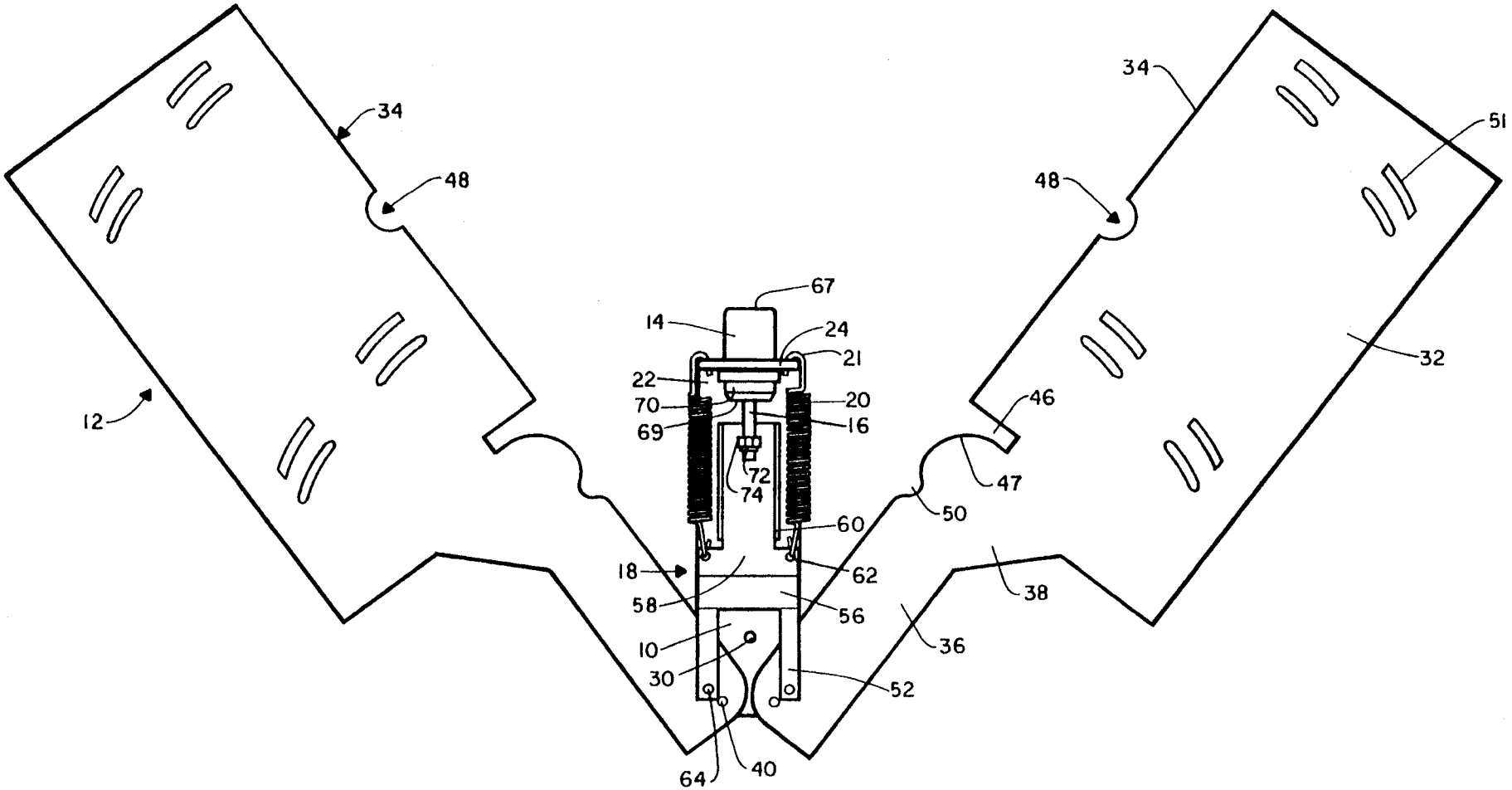
FIG. 6 is plan view of the diffuser of FIG. 1, shown in the open position.

The pill 14 controls the position of the diffuser vanes 12, which scissors between the closed position (as shown in FIG. 3) and the open position (as shown in FIG. 6). Thermally responsive actuators such as the pill 14 are commonly used in the auto industry. They contain a wax which expands upon melting, and thus have a distinct set temperature at which the piston extends. By selecting the proper wax, the temperature at which the pill 14 operates may be determined. For control of an air diffuser, a temperature of 75° F. is preferred.

When the temperature of the pill 14 is above 75° Fahrenheit, the wax inside the pill 14 expands, causing the piston 16 to move outwardly from the pill 14. The ring 70 about the pill 14 prevents further movement of the pill 14 through the hole 26 in the wall 24, and the piston 16 is connected to the bracket 18. Thus, movement of the piston 16 outwardly from the pill 14 causes the bracket 18 to move rearwardly, away from the wall 24. The force of the bracket's 18 rearward movement is sufficient to overcome the spring force of the springs 20, and to cause a torque on the pivot arms 36, opposite to the afore described torque from the springs 20, tending to urge the vanes 12 into the open position. If the temperature in the pill 14 falls below 75° Fahrenheit, the wax will solidify and contract, moving the piston 16 inwardly of the pill 14 and thereby allowing the springs 20 to move the vanes 12 into the closed position.

Although, a pill 14 is shown in this embodiment, other types of actuators would be suitable. For instance, a bellows containing a thermally expansible material could be employed in place of the pill 14. Also, the vane arrangement of the present invention is suitable for interfacing with the control system of the HVAC system, controlling an electric or pneumatic positioner in place of the pill 14. A manually adjustable positioner can also be employed in place of the pill 14.

As shown in FIG. 1, the air diffuser 8 is typically installed in a horizontal orientation in an exit 82 from an air duct 78 located in a ceiling 80. A perforated face plate 76 typically covers the duct exit 82. For proper operation of the diffuser 8, at least 60% of the face plate 76 area should be perforated.

When heated discharge air passes over the diffuser 8 and exits the face plate 76, it heats the pill 14 to the temperature of the discharge air. If the discharge air is above 75° Fahrenheit, the vanes will open as previously described. When the vanes 12 are in the open position, heated discharge air may pass through the center of the perforated face plate 76 and enter the building space with a generally vertical flow orientation. Warm drafts are generally not perceived as uncomfortable, and the warm air's natural buoyancy will promote proper mixing.

When cooled discharge air passes over the diffuser 8 and exits the face plate 76, it cools the pill 14 to the temperature of the discharge air. If the discharge air is below 75° Fahrenheit, the vanes will close as previously described. When the vanes 12 are in the closed position, cooled discharge air may not pass through the center of the face plate 76, but is forced to the side where it exits the face plate 76 with a substantially horizontal orientation. Cold air exiting with an angle less than 35 to 40 degrees with respect to the ceiling, will tend to hug the ceiling due to the Coanda effect afore described. It can then settle gradually into the room without causing uncomfortable, cold drafts.

While a particular embodiment of the invention has been shown, it will be understood, of course, that the invention is not limited thereto since modifications may be made by those skilled in the art, particular in light of the foregoing teachings. Reasonable variation and modification are possible within the foregoing disclosure of the invention without departing from the scope of the invention.

The embodiments of the invention in which an exclusive property or privilege is claimed as defined as follows:

1. An air diffuser arrangement, mountable in an air duct for control of air flow patterns through the duct, the diffuser arrangement comprising:

at least two vanes pivotably mountable to a supporting structure in the air duct, each of the vanes being disposed and movable within a plane between a closed position and at least one open position to selectively deflect air flowing through the central path of the air flow;

an actuator means, mountable to the supporting structure and connected to said vanes, for controlling positioning of the vanes; and each of the planes being parallel to each other, and the vanes controlling the air flow through the duct by selectively deflecting, in response to the actuator means, air flowing through the central path of the air flow, when positioned in the closed position.

2. An air diffuser arrangement according to claim 1 wherein the closed position is defined by the vanes abutting each other so as to divert substantially all of the air passing through the central path of the air flow.

3. An air diffuser arrangement according to claim 1 wherein the open positions are defined by at least one of the vanes being spaced apart from at least one other of the vanes.

4. An air diffuser arrangement according to claim 1 wherein each of the vanes comprises a first end and a second end, is pivotably mountable to the supporting structure at the first end, and the first ends of the vanes are in alignment so that the vanes are movable between the closed and open positions in a scissor-wise fashion.

5. An air diffuser arrangement according to claim 1 further comprising a biasing means mountable to the supporting structure for biasing the vanes towards the closed position.

6. An air diffuser arrangement according to claim 5 wherein the actuator means comprises a thermally responsive element, the thermally responsive element providing a force to overcome the biasing means and move the vanes to one of the open positions in response to temperatures exceeding a predetermined value.

7. An air diffuser arrangement according to claim 6 wherein the thermally responsive element comprises:

a container having a closed end and an opposite end;

a piston operating inside the container;

a pressure-tight seal between the piston and the container;

a thermally expansive material contained inside the container between the closed end and the piston;

a piston rod extending from the piston out of the opposite end of the container and interconnected to the vanes; and an expansive pressure is generated by increasing the temperature of the thermally responsive material and the pressure operating against the piston causes a force tending to move the piston and piston rod outwardly of the container to cause a force to overcome the biasing element and move the vanes to one of the open positions in response to temperatures exceeding a predetermined value.

8. An air diffuser arrangement, mountable in an air duct for control of air flow patterns through the duct, the diffuser arrangement comprising:

at least two vanes, each of the vanes pivotably mountable at a pivot point to a supporting structure in the air duct;

the vanes having at least one open position;

a control mechanism, mountable to the supporting structure, for applying a force at a location of each of the vanes to cause the application of torques about the pivot points associated with the corresponding vanes;

the control mechanism comprises a biasing means for applying a biasing force at each location to cause a biasing torque, and a positioning means for applying a positioning force at each location to cause an opposite positioning torque to control the position of the vanes; and the control mechanism, vanes and supporting structure are interconnected so that the locations on each of the vanes at which the biasing force is applied are the same locations at which the positioning forces are applied.

9. An air diffuser arrangement according to claim 8 wherein a closed position of the vanes is defined by the vanes abutting each other to divert substantially all of the air passing through the central path of the air flow.

10. An air diffuser arrangement according to claim 8 wherein the open position of the vanes is defined by at least one of the vanes being spaced apart from at least one other of the vanes.

11. An air diffuser arrangement according to claim 8 wherein each of the vanes has a first end and a second end, is pivotably mountable to the supporting structure at the first end, and the first ends of the vanes are in alignment so that the vanes are movable between the closed and open positions in a scissor-wise fashion.

12. An air diffuser arrangement according to claim 8, further comprising a wall mountable to the supporting structure, and wherein the biasing means comprises at least one spring connected between the vanes and the wall.

13. An air diffuser arrangement according to claim 12 wherein the positioning means comprises a thermally expandable unit, and wherein temperature above a predetermined level in said duct produces an expansive force on said expandable unit.

14. An air diffuser arrangement according to claim 13, further comprising an opening in the wall and a brace on the thermally expandable unit, and wherein the thermally expandable unit is partially received in the opening and the brace prevents further movement, in at least one direction, of the thermally expandable unit through the opening.

15. An air diffuser arrangement according to claim 11 wherein the control mechanism further comprises a bracket, connected between the vanes of the biasing and the positioning means, for translating forces between the biasing and the positioning means to the vanes so as to cause the application of the biasing and positioning torques on the vanes about the pivot points.

16. An air diffuser arrangement according to claim 1 wherein the planes are common.

* * * * *